US005882078A

United States Patent [19]

Gebhard

[11] Patent Number: 5,882,078

[45] Date of Patent: Mar. 16, 1999

[54] CLAMP ADJUSTABLE-HEIGHT SEAT-BACKS

[75] Inventor: Reinhard Gebhard, Burgthann, Germany

[73] Assignee: SIFA Sitzfabrik GmbH, Germany

[21] Appl. No.: 913,134

[22] PCT Filed: Nov. 22, 1996

[86] PCT No.: PCT/DE96/02245

§ 371 Date: Nov. 10, 1997

§ 102(e) Date: Nov. 10, 1997

[87] PCT Pub. No.: WO97/24957

PCT Pub. Date: Jul. 17, 1997

[30] Foreign Application Priority Data

Jan. 8, 1996 [DE] Germany ..... 296 00 214 U

[51] Int. Cl.[6] ..... A47C 7/40

[52] U.S. Cl. ..... 297/353; 248/412

[58] Field of Search ..... 248/353, 411.36, 248/295.11, 411, 412

[56] References Cited

U.S. PATENT DOCUMENTS

| | | | |
|---|---|---|---|
| 1,630,870 | 5/1927 | Strunck | 248/412 |
| 4,430,017 | 2/1984 | Stefancich | 248/411 X |
| 4,932,622 | 6/1990 | Hayakawa | 248/411 X |
| 5,449,004 | 9/1995 | Parsons et al. | 248/316.3 X |

FOREIGN PATENT DOCUMENTS

| | | | |
|---|---|---|---|
| 927153 | 5/1963 | United Kingdom | 297/353 |

*Primary Examiner*—Peter R. Brown
*Attorney, Agent, or Firm*—Morrison Law FIrm

[57] ABSTRACT

A clamp (1) for adjustable-height seat-backs, consisting of a guide member (2) for a tubular component (3) of the seat-back and a clamping device for clamping said tubular component in the guide member, the clamping device consisting of a clamping member (10) fitted on an upper pivot to swivel on the tubular component (3) or a component beside and firmly secured to it, and an actuator (6), the actuator (6) being fitted beneath the pivot of the clamping member (10) so as to rotate behind it in relation to the tubular component (3), and the actuator (6) having at least two different diameters from its pivot.

3 Claims, 2 Drawing Sheets

CLAMP ADJUSTABLE-HEIGHT SEAT-BACKS

The invention relates to a clamping arrangement for height-adjustable back rests.

Such clamping arrangements, consisting of a guide section for a tubular section of the back rest and a clamping means such as a screw for clamping the tubular section in the guide section, have long been known. Known from DE-U-295 10 446.5 is a back rest clamping arrangement in which a clamping body can firmly engage with the tubular section of a back rest by means of a laterally arranged. However, known clamping arrangements often have the disadvantage that the tubular section will loosen in time.

The objective of the present invention is to create a clamping arrangement for height-adjustable chair back rests which will not loosen over the long term and which are easy and comfortable to operate.

Further developments and advantageous embodiments of the invention are described hereinafter.

According to the invention, a clamping arrangement for clamping the tubular section of a back rest consists of a clamping body pivotably mounted to an upper pivot point to swivel on the tubular section in the guide section or an adjacent section firmly mounted to same, and an actuator body, whereby the actuator body is pivotably arranged behind the clamping body, below the pivot point of the clamping body, to swivel on the tubular section, and whereby the actuator body has at least two different diameters, seen from its pivot axis.

According to a preferred embodiment of the invention, the actuator body has a helical cross section. The clamping body is mounted on a bolt in the lower guide section by a pivot arm pointing downward, and the bottom end of the pivot arm adjoins the actuator body in at least one of its positions.

It is an advantage when the clamping body or the pivot arm is provided with an elastically mounted catch for a recess in the tubular section of the back rest.

The invention is described below by way of example and with reference to the drawings, in which.

Figure 1:
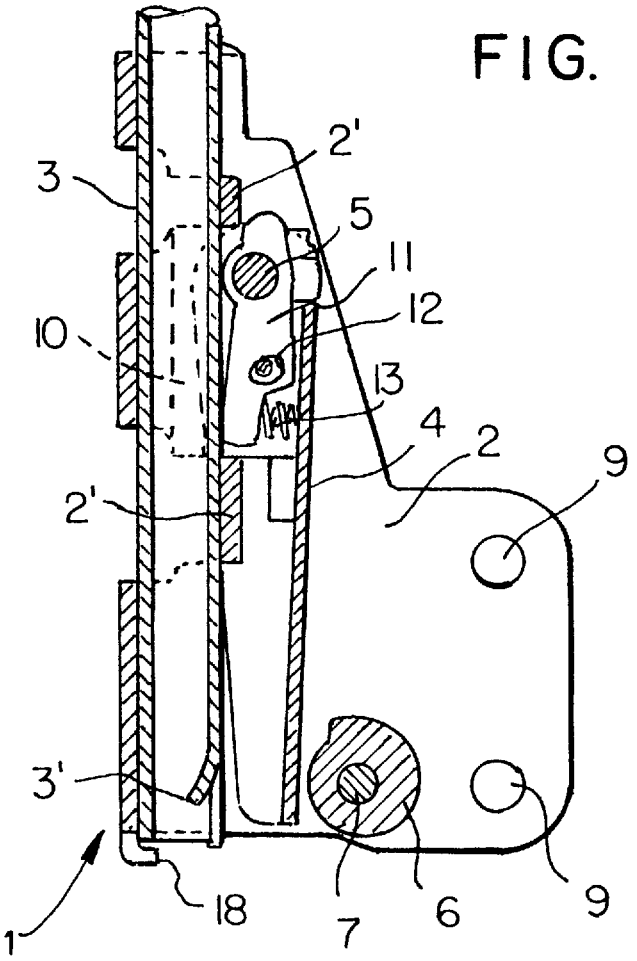
FIGS. 1 to 3 show three views of a clamping arrangement including a sectional view in FIG. 1.
Figure 2:
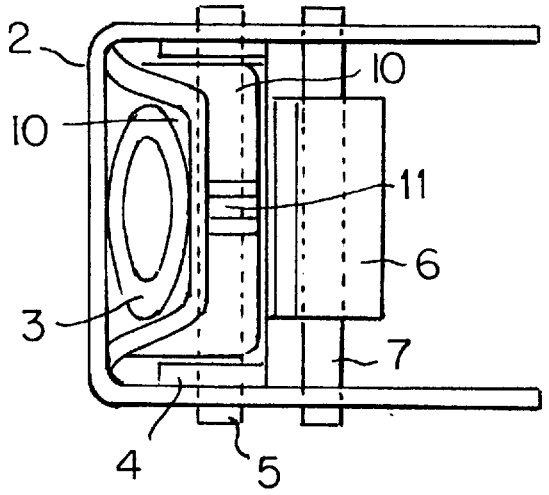
Figure 3:
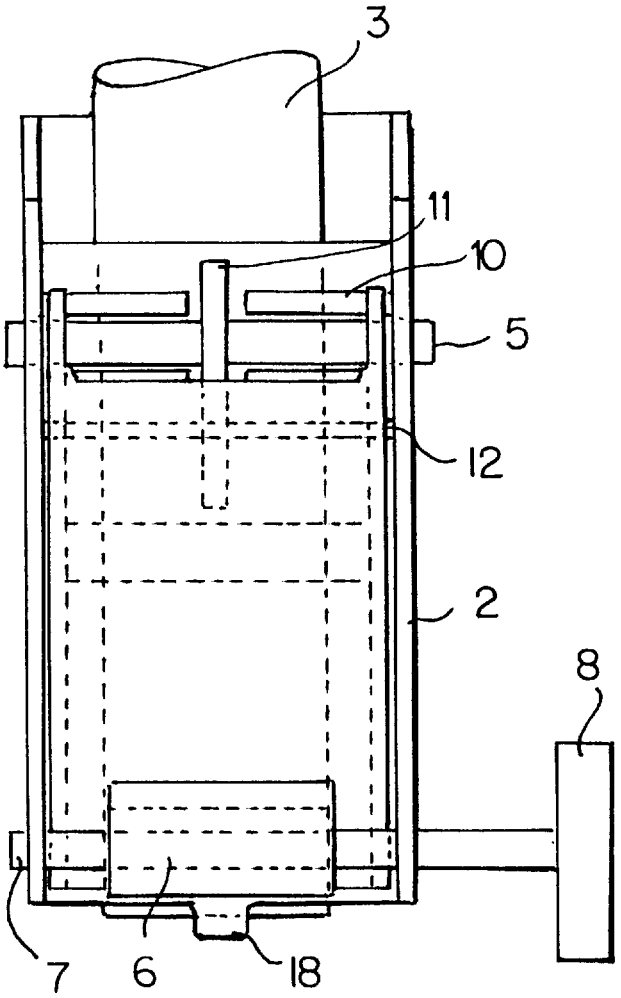
Figure 4:
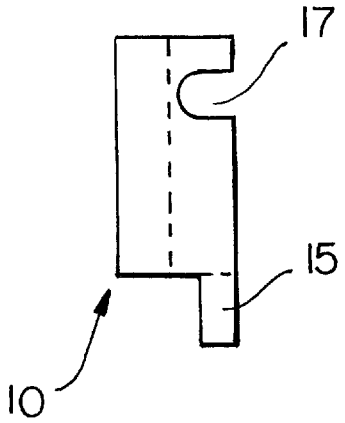
FIGS. 4 to 6 show three views of the clamping body of FIGS. 1 to 3.
Figure 5:
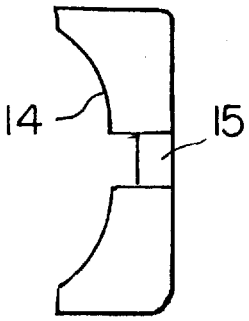

The clamping arrangement according to FIGS. 1 to 3 consists of a guide section 2 with one rear wall and two lateral walls, so that the top view shows a U-shaped cross section, whereby the rear wall is provided with two inwardly bent notches 2', so that a tubular section 3 of a back rest can slide in the guide formed by notches 2' and the rear wall, and of a clamping means for clamping tubular section 3 in the desired insertion depth. The clamping means consists of a clamping body 10 which together with a pivot arm 4 is pivotably mounted to a bolt 5 which is attached laterally and above in guide section 2, and of an actuator body 6. As is shown in the top view, clamping body 10 adjoins the tubular section 3. For this purpose, as is shown more clearly in FIG. 5, its contour 14 is adapted to tubular section 3. The clamping body 10 is fastened to the side walls of pivot arm 4 by means of a pin 12, catches or some such. For bolt 5, it is provided in its rear wall with a groove 17 shown in detail in FIG. 4. The rear wall of pivot arm 4 is recessed in this area. In the position shown, the clamping body 10 only adjoins tubular section 3 and does not clamp it. The side walls of guide section 2 are provided with holes 9 for fastening to a seat carrier.

Pivot arm 4, which in top view has a U-shaped cross section open toward the tubular section 3, and whose side walls partially surround clamping body 10, is extended toward the bottom and can be made to engage with an actuator body 6. The actuator body 6 is mounted on a pivotable lateral bolt 7 in the side walls of guide section 2. As shown in FIG. 3, lateral bolt 7 is extended on one side and provided with a hand wheel. In the cross sectional view, the actuator body 6 has a helical contour. In FIG. 3, the side of actuator body 6 with the smallest circumference is turned toward the bottom end of pivot arm 4. If the actuator body 6 is turned clockwise, the side with the greater circumference will finally press upon pivot arm 4, which causes clamping body 10 to be pressed onto the tubular section 3. The result is a very high clamping force.

Figure 6:
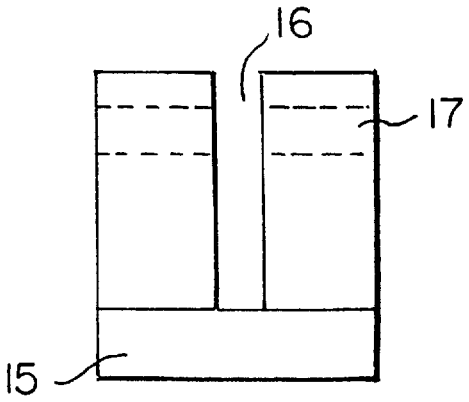

Tubular section 3 is secured against unintentional pulling-out and overly deep insertion. Integrated in clamping body 10 is a pull-out stop. It consists of a latch 11 pivotably mounted on bolt 5. As FIG. 6 shows, clamping body 10 is provided with a vertical groove 16 for this purpose. Latch 11 extends downward in groove 16 and is provided with a recess for pin 12 or catches or some such, which also limits the path of latch 11. Latch 11 is charged by a spring 13 which is mounted on a journal between the bottom end of latch 11 and the rear wall of pivot arm 4. Thus, latch 11 pushed onto tubular section 3. If the same is pulled out, latch 11 locks in an opening 3' at the bottom end of tubular section 1 and is stopped. When tubular section 3 is pushed in, latch 11 slides out of opening 3' without resistance. Guide section 2, below the channel for the tubular section, is provided with a nose 18 which prevents that the tubular section is pushed through farther.

I claim:

1. Clamping arrangement which clamps a tubular section of a chair height-adjustable back rest on a chair guide section defining tubular section receptive structure, the clamping arrangement comprising a clamping body pivoted on the guide section and disposed adjacent the tubular section, an actuator body pivotably mounted in the guide section below a pivot location of the clamping body in relation to the tubular section, and a pivot lever pivot mounted at an end thereof on a common axis with the clamping body and fastened with said clamping body, an opposite end of the pivot lever locating proximal said actuator body, the actuator body having a circumferential contour with two different diameter section as seen from a pivot axis thereof, one circumferential diameter section having a diameter greater than a diameter of a other circumferential sections, rotation of said actuator diameter section body in a given direction bring said one circumferential diameter section thereof into pressing contact with the opposite end of said pivot lever whereby said pivot lever presses said clamping body against the tubular section therewith clamping same, rotation of said actuator body in an opposite direction to bring the other circumferential diameter section proximal said pivot lever opposite end disengaging contact between said actuator body and said pivot lever opposite end.

2. Clamping arrangement for a chair height-adjustable back rest according to claim 1, in which the actuator body two circumferential sections define a helical surface contour.

3. Clamping arrangement for a chair height-adjustable back rest according to claim 1, in which one of the clamping body and the pivot lever is provided with an elastically mounted catch or latch for a recess in the tubular section of the back rest.

* * * * *